United States Patent [19]

Kuus

[11] 4,203,049

[45] May 13, 1980

[54] ELECTRIC LAMP WITH HYDROGEN GETTER AND HYDROGEN GETTER

[75] Inventor: Gijsbert Kuus, Eindhoven, Netherlands

[73] Assignee: U.S. Philips Corporation, New York, N.Y.

[21] Appl. No.: 914,135

[22] Filed: Jun. 9, 1978

[30] Foreign Application Priority Data

Jun. 27, 1977 [NL] Netherlands ..... 7707079

[51] Int. Cl.[2] ..... H01K 1/54

[52] U.S. Cl. ..... 313/174; 313/178; 417/48; 252/181.1; 252/181.6

[58] Field of Search ..... 313/174, 178; 417/48; 252/181.1, 181.2, 181.3, 181.6

[56] References Cited

U.S. PATENT DOCUMENTS

| | | | |
|---|---|---|---|
| 3,737,709 | 6/1973 | Hornman et al. | 313/174 |
| 3,805,105 | 4/1974 | Gungle | 313/174 X |
| 3,821,585 | 6/1974 | Jansson et al. | 313/174 X |
| 3,829,731 | 8/1974 | T'Jampens et al. | 313/174 X |

*Primary Examiner*—Rudolph V. Rolinec
*Assistant Examiner*—Darwin R. Hostetter
*Attorney, Agent, or Firm*—Robert S. Smith

[57] ABSTRACT

Electric lamps having a gas-filled lamp envelope according to the invention have a hydrogen getter consisting of a coherent mixture of 65–90% by weight of zirconium powder having a particle size of 100–1,000 μm and 35–10% by weight of nickel powder.

3 Claims, 2 Drawing Figures

ELECTRIC LAMP WITH HYDROGEN GETTER AND HYDROGEN GETTER

The invention relates to an electric lamp having a gas-filled glass envelope in which is accommodated, in addition to a light source, a hydrogen getter containing zirconium and a second metal. Current supply conductors to the light source are passed through the wall of the lamp envelope in a vacuum-tight manner.

The expression electric lamp is to be understood to mean herein both an incandescent lamp, in which case the light source is a filament, and a discharge lamp, in which case the light source is a vacuum-tight closed discharge vessel having electrodes arranged therein. The term electric lamp is also to be understood to include a mixed light lamp, that is a discharge lamp in which the envelope comprises both a discharge vessel and a filament. The discharge lamps may be high-pressure sodium vapour discharge lamps or high-pressure mercury vapour discharge lamps, with or without halide additions. The discharge vessel may be quartz glass or mono- or polycrystalline ceramic, for example, translucent, gas-tight aluminium oxide, through the wall of which vessel current conductors are passed to the electrodes in a vacuum-tight manner.

German Gebrauchsmuster 1912567 discloses incandescent lamps having a zirconium-aluminium alloy as a getter; Netherlands Patent Application 70 11 321 discloses high-pressure mercury vapour discharge lamps having a zirconium alloy as a getter. In this literature the construction of the getters is not described in detail.

A detailed description of zirconium-containing getters is given in the following Patent Specifications: German Pat. No. 1152485 and U.S. Pat. No. 3,187,885. According to the first-mentioned Patent Specification, zirconium hydride powder having a grain size of less than 5 μm is mixed with an even finer tungsten powder and possibly with nickel powder. The mixture is granulated and compressed to form tablets. The hydride in a discharge tube is converted into zirconium when the hydride is heated.

The above-mentioned United States Patent describes a getter which is also destined for use in discharge tubes. Fine metal grains have been combined to form agglomerates having a diameter of a few tens to a few hundreds of μm, preferably 100–200 μm.

It is the object of the invention to provide an electric lamp having a hydrogen getter which is capable of removing hydrogen from a mixture with other gases, for example nitrogen and rare gases, in a very rapid manner and to a very low residual pressure.

In agreement herewith the invention relates to an electric lamp of the kind mentioned in the preamble which is characterized in that the hydrogen getter consists of a coherenet mixture of 65–90% by weight of zirconium powder having a particle size of 100–1000 μm and 35–10% by weight of nickel powder.

It is remarkable that, whereas in the above described literature e.g. U.S. Pat. No. 3,187,885 a very small particle size of the zirconium powder is emphasized, it has now been found that the rate at which hydrogen is gettered in lamps according to the invention is considerably increased with a move coarsely divided zirconium getter.

The getter may be compressed or sintered in the form of tablets, be situated as a powder in a holder which is permeable to gas, or be provided with a binder on a lamp part. If the getter is used in powder form, the powder mixture is first sintered at approximately 800°–900° C. to give the components coherences.

Tablets may also be obtained from a sintered mixture. A part of the nickel powder present in the getter may be added, if desired, only after sintering zirconium powder and nickel powder. The mixture to be tableted may be diluted with up to 20% by weight of tungsten powder, which is of no significance as a getter, but which, in the case of a dense packing of the getter powder, increases the accessibility of grains not situated at the surface of the gettering mass for the gas to be gettered.

A favorable property of the getter is that it can be processed in air. This simplifies the manufacture of a lamp containing the hydrogen getter. In addition, the getter need not be activated to perform its great activity.

Furthermore, the temperature of the getter during operation of the lamp is not very critical. In general the getter is located in places which have a temperature between 100° and 500° C. This wide temperature range makes it possible to operate a lamp in a variety of positions without the danger of the getter having too high or too low a temperature dependent on the operating position of the lamp. If possible, the getter is provided in a place which is at a temperature of 250° to 300° C. during operation of the lamp.

In spite of the presence of other gases, such as rare gases and nitrogen, the getter is capable of gettering hydrogen to a residual pressure of less than $10^{-6}$ atmospheres. The quantity of getter which is necessary for this purpose depends for example on the nature of the material present in the lamp and the quality of the cleaning processes to which the lamp and components thereof are subjected. For a given lamp, however, the necessary quantity of getter can easily be established by performing a small series of experiments.

The nickel powder and the tungsten powder used in general have a particle size of 1–10 μm.

Embodiments of the invention will be described with reference to the figures.

Figure 1:
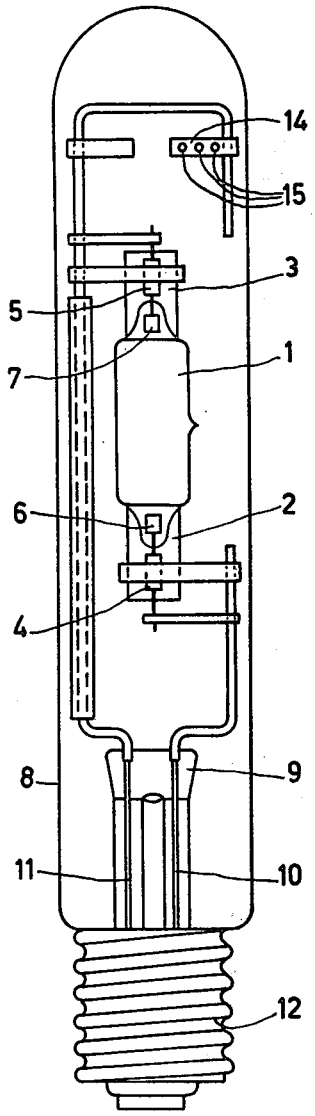
FIG. 1 is a side elevation of a high-pressure discharge lamp.

Reference numeral 1 in FIG. 1 denotes the quartz glass discharge vessel of a high-pressure mercury vapor discharge lamp sealed by means of the pinches 2 and 3. Current conductors 4 and 5 to the electrodes 6 and 7 are incorporated in the pinches 2 and 3.

The discharge vessel 1 is mounted in a glass nitrogen-filled envelope 8 having an assembly 9 through which current supply conductors 10 and 11 extend at one end to a lamp cap 12, at the other end to the current conductors 4 and 5 of the discharge vessel. The current supply conductor 11 is bent at its end situated in the envelope so as to center the discharge vessel in the envelope. At the bent end, the current supply conductor 11 also comprises a metal strip 14 having cavities 15. A mixture of 70 mg of zirconium powder (particle size 100–160 μm) and 20 mg of nickel powder (10 μm) was heated at 900° C. for 1 hour. The resulting sintered powder was mixed with 10 mg of nickel powder and 10 mg of tungsten powder both having a particle size of 10 μm. Approximately 100 mg of the resulting mixture was pressed into the cavities 15 at a pressure of 10,000 Newtons/cm$^2$. During operation the lamp consumes a power of 400

Watt and the zirconium/nickel getter is at a temperature between 200° and 250° C.

Figure 2:
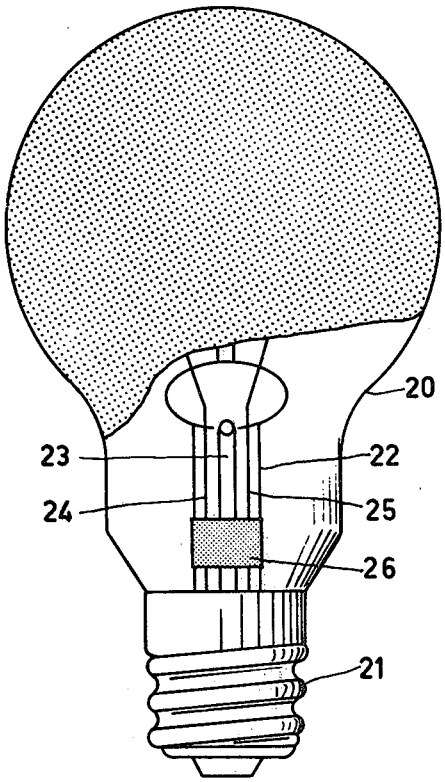
FIG. 2 is a side elevation of an incandescent lamp with part of the envelope broken away.

In FIG. 2, the lamp envelope 20 has a lamp cap 21 from which current supply wires 25 and 24 extend to the filament (not shown) through a stem tube 22. A coating 26 of sintered powder consisting of 83% by weight of Zr powder of 200 μm and 17% by weight of Ni powder of 10 μm is provided around the stem tube 22. The getter is provided as a dispersion in a solution of nitrocellulose in amyl acetate. The lamp envelope has a gas filling consisting mainly of argon.

What is claimed is:

1. An electric lamp which comprises: a glass envelope and a plurality of elements disposed within said envelope which include a gas filling, a light source, current supply conductors connected to said light source and a hydrogen getter consisting of a uniform mixture of 65–90% by weight of zirconium powder having a particle size of 100–1000 microns and 35–10% by weight of nickel powder.

2. An electric lamp as claimed in claim 1, wherein said lamp further includes a quantity of tungsten powder, said tungsten powder being mixed with said hydrogen getter and said quantity being up to 20% of the weight of said hydrogen getter.

3. A hydrogen getter for use in an associated electric lamp which comprises a uniform mixture of 65–90% by weight of zirconium powder having a particle size of 100–1000 microns and 35–10% by weight of nickel powder.

* * * * *